US012109598B1

(12) United States Patent
Liu et al.

(10) Patent No.: US 12,109,598 B1
(45) Date of Patent: Oct. 8, 2024

(54) CORRUGATED SKEW ROLLING PREPARATION METHOD OF MAGNESIUM ALLOY BAR WITH GRADIENT STRUCTURE

(71) Applicant: TAIYUAN UNIVERSITY OF TECHNOLOGY, Taiyuan (CN)

(72) Inventors: Jianglin Liu, Taiyuan (CN); Linchao Zhao, Taiyuan (CN); Renhui Zheng, Taiyuan (CN); Jianguo Liang, Taiyuan (CN); Zhihui Wang, Taiyuan (CN); Xiaodong Zhao, Taiyuan (CN); Yinhui Li, Taiyuan (CN); Haifeng Gao, Taiyuan (CN); Lianyun Jiang, Taiyuan (CN); Chunjiang Zhao, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 18/673,440

(22) Filed: May 24, 2024

(30) Foreign Application Priority Data

Apr. 16, 2024 (CN) ..... 202410452618.5

(51) Int. Cl.
*B21B 1/20* (2006.01)
*B21B 27/02* (2006.01)

(52) U.S. Cl.
CPC ..... *B21B 1/20* (2013.01); *B21B 27/025* (2013.01)

(58) Field of Classification Search
CPC ..... B21B 1/20; B21B 13/008; B21B 19/02; B21B 19/04; B21B 19/06; B21B 27/025
See application file for complete search history.

(56) References Cited

U.S. PATENT DOCUMENTS 1,141,425 A * 6/1915 Simpkins ..... B21B 19/04 72/97
3,656,332 A * 4/1972 Marcovitch ..... B21H 1/18 72/107
4,202,194 A 5/1980 den Hartog et al.
(Continued)

FOREIGN PATENT DOCUMENTS

CN 1278155 A 12/2000
CN 2461689 Y 11/2001
(Continued)

OTHER PUBLICATIONS

CN 110802125A, Yu et al. Feb. 2020.*
(Continued)

*Primary Examiner* — Edward T Tolan

(57) ABSTRACT

The present disclosure provides a corrugated skew rolling preparation method of a magnesium alloy bar with a gradient structure, adopts a three-roller skew rolling mill, adding a corrugated curve to a flat roll rolling section of the three-roller skew rolling mill to form a corrugated roll, the billet used is as-cast magnesium alloy bar, and steps include: simulated rolling physical experiment; rolling parameters setting; bar homogenization annealing treatment; heating treatment of bars before rolling; three-roller skew mill rolling; cooling of the rolled parts after rolling. Thus improving the preparation efficiency and preparation quality of the magnesium alloy bar with gradient structure. And further improves the formiability of magnesium alloy bar with gradient structure.

5 Claims, 10 Drawing Sheets

(56) References Cited

U.S. PATENT DOCUMENTS

| | | | | | |
|---|---|---|---|---|---|
| 4,470,282 | A | * | 9/1984 | Hayashi | B21B 19/04 72/97 |
| 2003/0051524 | A1 | | 3/2003 | Potthoff et al. | |

FOREIGN PATENT DOCUMENTS

| | | | | | |
|---|---|---|---|---|---|
| CN | 101380641 | A | | 3/2009 | |
| CN | 108220725 | A | | 6/2018 | |
| CN | 108453130 | A | | 8/2018 | |
| CN | 110802125 | A | * | 2/2020 | B21B 1/20 |
| CN | 112044950 | A | | 12/2020 | |
| CN | 112718867 | A | | 4/2021 | |
| CN | 114855043 | A | | 8/2022 | |
| CN | 219211095 | U | | 6/2023 | |
| DE | 102012007379 | A1 | | 1/2014 | |
| EP | 0601630 | A1 | | 6/1994 | |
| GB | 191202122 | A | * | 11/1912 | B21B 1/20 |
| JP | H02263506 | A | | 10/1990 | |

OTHER PUBLICATIONS

CN 106391714A, Ding et al. Feb. 2017.*
CN 110252814A, Yang et al. Sep. 2019.*
CN 114406004A, Liu et al. Apr. 2022.*
Zhou, Daozhi, "Manufacture Process and Equipment Configuration of Rotary Elongating Pipe Mill with Pull Mandrel", Steel Tube, Issue 5, Oct. 28, 1996, pp. 12-15.
Liu Jiang-lin et al., "3D Thermo-mechanical Coupling Finite Element Analysis of Piercing Process for TA2 Bar Billet", Forging & Stamping Technology, vol. 37, No. 3, Jun. 30, 2012, pp. 59-61.
Teresa Bajor et al., "Analysis of the Rolling Process of Alloy 6005 in a Three-High Skew Rolling Mill", Materials, vol. 13, No. 5, Mar. 3, 2020, pp. 1-12.
Fei Long Mao et al., "Theoretical and Experimental Study of the Tandem Skew Rolling Process", steel research international, vol. 89, No. 8, May 2, 2018, pp. 1-14.

* cited by examiner i Biting section ii Rolling section
iii Uniformization section iv Round part

CORRUGATED SKEW ROLLING PREPARATION METHOD OF MAGNESIUM ALLOY BAR WITH GRADIENT STRUCTURE

CROSS REFERENCE TO RELATED APPLICATIONS

This application claims foreign priority of Chinese Patent Application No. 202410452618.5, filed on Apr. 16, 2024 in the China National Intellectual Property Administration, the disclosures of all of which are hereby incorporated by reference.

TECHNICAL FIELD

The present disclosure relates to a technical field of metal material processing, in particular to a corrugated skew rolling preparation method of magnesium alloy bar with gradient structure.

BACKGROUND

Due to its high specific strength and biodegradability, magnesium alloy has been widely used in automotive, aerospace and biomedical fields, but its low strength and poor plasticity limit its application. It has been well established that grain refinement is a limited route to promote both plasticity and strength. Extrusion, rolling, stamping and forging have been proved to be the most efficient, high quality and low cost plastic processing and production technology. However, due to the particularity of magnesium alloy, it is very difficult to make a breakthrough in the traditional process. Because magnesium and magnesium alloy have hexagonal close packed (HCP) structure, they are not easy to carry out pressure processing and forming processing.

At present, the production of magnesium alloy bar is mainly concentrated on the extrusion and rolling process. The extrusion is mainly is equal channel angle extrusion (EPAC). Rolling is mainly concentrated on three-roller radial shear rolling and groove rolling. For equal channel angle extrusion (EPAC), a Chinese application of No. 202210499075.3 "An ultra-fine crystal high strength plastic magnesium alloy and a preparation method therefore" provides the ultra-fine crystal magnesium alloy bar by extrusion and rolling process. However, the extrusion and rolling process is complex, and requires multiple extrusion and rolling steps to achieve tissue refinement. Although the ultra-fine crystal magnesium alloy bar is prepared, the texture produced by extrusion and rolling process prevents the dislocation slip on the base surface, which can improve the ductility of magnesium, but can offset the grain refinement enhancement effect produced by EPAC. And the prepared samples are usually short rod-like samples, which cannot realize the high efficiency continuous preparation of large size ultra-fine crystal magnesium alloy. The ultra-fine crystal magnesium alloys prepared by severe t plastic deformation technology usually contain structural defects such as high density dislocation, which makes their plastic deformation ability poor and can not meet the engineering matching requirements for material strength and plasticity.

The rolling process mainly includes a severe shear deformation and a metal densification on the surface of the metal material. A Chinese application of No. 201810308821.X "A preparation method of high-performance magnesium alloy bar" prepares a magnesium alloy bar by using a groove rolled bar through a diamond hole, a square hole, a diamond hole and a square hole successively. For this method, the rolling efficiency is low, the temperature control is complex, and the equipment covers a large area. Thus, the preparation method is difficult to carry out flexible production, which is not conducive to large-scale industrial application. Literature "Improving the mechanical properties of pure magnesium by three-roll planetary milling" indicates that the three-roller skew rolling magnesium alloy bar can increase the rolling angle to 18° to 240 (common rolling angle is generally 4° to 6°). The process is based on the rolling process principle proposed by P. I. Polukhin and I. N. Potapov in the 1970s, its main purpose is to obtain a large radial shear stress to activate the sliding mechanism of the magnesium alloy, and increase additional deformation capacity. This process produces surface grain refinement in one processing, which makes the gradient difference between the surface and the heart of the bar.

The fine crystal gradient structure can be obtained by the three-roller radial shear rolling technique. In this rolling process, the three rollers are equidistant interval distributed around a rolling center line, and the biting and rolling of the bar are realized through the friction between the roll and the bar, and the rolling center line and the axis of the bar are in the same position, and the three roll axes have an angle relationship with the rolling center line in space, that is, the biting angle and the rolling angle. Through the three-roll radial shear rolling technique, enough shear stress is generated on the surface of the bar to activate more independent slip systems.

However, for the three-roll radial shear rolling magnesium alloy bar, due to the poor plastic deformation ability of magnesium alloy at room temperature, cracks and other deformation defects are easy to appear in the rolling process; the structure after rolling has a strong base texture, there is serious anisotropy, which is not conducive to subsequent processing.

SUMMARY

Aiming at the above background of the present disclosure, magnesium alloy bar in the three-roller radial shear rolling has the poor plastic deformation ability at room temperature, leading to deformation problems such as cracks in the rolling and serious anisotropy due to the strong base texture after rolling, which is not conducive to subsequent processing. Therefore, the present disclosure creatively introduces the local strong stress of corrugated roll rolling from the large shear deformation of three-roller skew rolling, so that the magnesium alloy bar obtains greater surface crushing and heart deformation during rolling, thus obtaining the target magnesium alloy bar with gradient structure, and simultaneously taking into account the strength and plasticity of the magnesium alloy bar. Herein, the present disclosure provides a corrugated skew rolling preparation method of magnesium alloy bar with gradient structure.

In order to achieve the above purpose, the present disclosure adopts the following technical solutions: a corrugated skew rolling preparation method of magnesium alloy bar with gradient structure, which adopts a three-roller skew rolling mill, adding a corrugated curve to a flat roll rolling section of the three-roller skew rolling mill to form a corrugated roll, a as-cast AZ31 magnesium alloy bar is used as a billed, and steps of the preparation method are as follows:

S1, simulated rolling physical experiment: adopting an Abaqus finite element software to carry out a simulation calculation to obtain a macroscopic deformation law of the as-cast magnesium alloy bar and carry out a rolling physical experiment;

S2, rolling parameters setting: according to results of the rolling physical experiment in S1, setting rolling parameters of a transformed three-roller skew rolling mill, where, a roll feed angle γ is set to 8° to 12°, a rolling angle β is set to 6° to 100, a roll speed is set to 300 r/min to 500 r/min, and a throat diameter is adjusted to 60 mm;

S3, bar homogenization annealing treatment: in an argon environment, adopting a box furnace to homogenize and anneal the as-cast magnesium alloy bar, a homogenized annealing temperature is 520° C. to 540° C., and a annealing holding time is 50 minutes to 70 minutes; AZ31 is a type of magnesium alloy bar, and the processing technique of AZ31 magnesium alloy bar is rolling, which has the characteristics of high strength, low density and good elasticity. The main component of AZ31 magnesium alloy bar is Mg, containing a small amount of AL and a trace amount of Mn.Zn;

S4, heating treatment of bars before rolling: in the argon environment, adopting the box furnace to heat an annealed AZ31 magnesium alloy bar after S3 treatment to 350° C. to 400° C., and keeping 20 minutes to 30 minutes;

S5, three-roller skew mill rolling: sending the annealed magnesium alloy bar treated by S4 to the three-roller skew rolling mill for rolling, to obtain rolled parts;

S6, cooling of the rolled parts after rolling: adopting an air cooling method to cool the rolled parts after S5 rolling, to obtain a target magnesium alloy bar with a gradient structure.

As a further supplement to the above technical solution, in S1, the simulated rolling physical experiment includes the following steps:

S1.1, establishing a finite element model: in Abaqus finite element software, replacing all three rolling flat rolls in the flat roll rolling section of the three-roller skew rolling mill with corrugated rolls, where the corrugated curves on the corrugated rolls are sinusoidal curves, and the three corrugated rolls are equidistant interval distributed around a rolling center line, where the roll feed angle γ is 8° to 12°, the rolling angle β is 6° to 10°;

S1.2, simulated rolling: a rolling billet is the annealed AZ31 magnesium alloy bar, inputting the rolling parameters, which are obtained from thermal simulation compression, into the Abaqus finite element software, defining a contact type between a corrugated roll and the annealed magnesium alloy bar as rigid-flexible contact, setting an initial rolling temperature at 350° C. to 400° C., setting the roll speed at 300 r/min to 500 r/min, setting a bar feed speed at 10 mm/s to 15 mm/s and a roll temperature is room temperature, and the bar mesh is divided into C3D8R mesh cells, adopting a thermodynamic coupling explicit dynamic analysis to simulate the finite element model;

S1.3, rolling parameters extraction: selecting three tracking points from the center to the surface of the magnesium alloy bar the step of S1.2, and a r/R of the three tracking points are 0.1, 0.5 and 0.9 respectively, where R represents the radius of the magnesium alloy bar after the step of S1.2 simulated rolling and r represents the distance between the tracking points and the rolling center line; extracting values of equivalent plastic strain, temperature values, values of shear stress and values of shear strain of the three tracking points to obtain an evolution law of the magnesium alloy bar during a process of corrugated rolls rolling;

S1.4, orthogonal experiment: to ensure that other rolling parameters remain unchanged, by setting the corrugated roll and flat roll respectively to simulate the orthogonal experiment; and comparing the distribution difference of the values of equivalent plastic strain, the temperature values, the values of shear stress and the values of the shear strain of the as-cast AZ31 magnesium alloy bar during the process of corrugated roll rolling and flat roll rolling, respectively.

In another embodiment, in S1.1, the corrugated curves are added in the corrugated roll at the flat roll rolling section, and a period length T of the corrugated curves is less than a width L of the flat roll rolling section, wherein the corrugated curves are the sinusoidal curves, and the corrugated curves of the three rolling flat rolls are the same, and an amplitude A of the corrugated curves added to the flat roll rolling section is guaranteed to skip exceeding a maximum height H of the flat roll rolling section.

In another embodiment, in S5, a radius depression rate of the annealed AZ31 magnesium alloy bar ranges from 5% to 8%.

In another embodiment, in S1.2, a radius depression rate of the annealed AZ31 magnesium alloy bar ranges from 5% to 8%.

In another embodiment, in S3, a homogenized annealing temperature is 530° C., and a annealing holding time is 60 minutes.

Comparing with the prior art, the present disclosure has the following advantages:

1. combing the skew rolling with the three-roller skew rolling, to obtain local strong stress through the corrugated rolling and to obtain radial large shear deformation through the three-roller skew rolling, in the rolling process. Carrying out the strong shear deformation and metal densification on the surface of magnesium alloy bar, to activate a pyramidal slip of magnesium alloy through the great shear stress produced during the process of strong shear deformation. Simultaneously the great shear stress is configured to make magnesium alloy bar to activate twin crystals, more activation of slip systems and twin crystals is conducive to dynamic recrystallization, thus making grain size refinement and different shear stress on the surface and heart of magnesium alloy bar. So as to prepare magnesium alloy bars with gradient structure. Therefore the present disclosure improves the preparation efficiency and preparation quality of the magnesium alloy bar with gradient structure.

2. The billet of the present disclosure is selected as-cast AZ31 magnesium alloy bar, making the rolled parts after rolling have better mechanical properties and secondary formability. Thus, the present disclosure greatly improves the anisotropy of magnesium alloy bar after rolling, and further improves the formiability of magnesium alloy bar with gradient structure.

3. When the magnesium alloy bar passes through the uniformization section, the bulge of magnesium alloy bar produced in the rolling section of corrugated roll is pressed into the depression, which improves the surface metal flow of the magnesium alloy bar and increases the surface strength of the magnesium alloy bar. Thus, the magnesium alloy bar with gradient structure prepared by the present disclosure is configured to obtain a better gradient microstructure.

4. In a rolling forming process of the present disclosure, compared with flat roll rolling, the strain and stress of magnesium alloy bar are much greater than that of flat roll rolling. Thus, the present disclosure further improves the processing efficiency of magnesium alloy bar with gradient structure.

DETAILED DESCRIPTION OF THE EMBODIMENTS

In order to further illustrate the technical solutions of the present disclosure, with FIGS. 1 to 16, and according to the simulated rolling physical experiment and the specific rolling implementation process, further descripting the present disclosure by combining specific embodiments.

Embodiment 1

Figure 1:
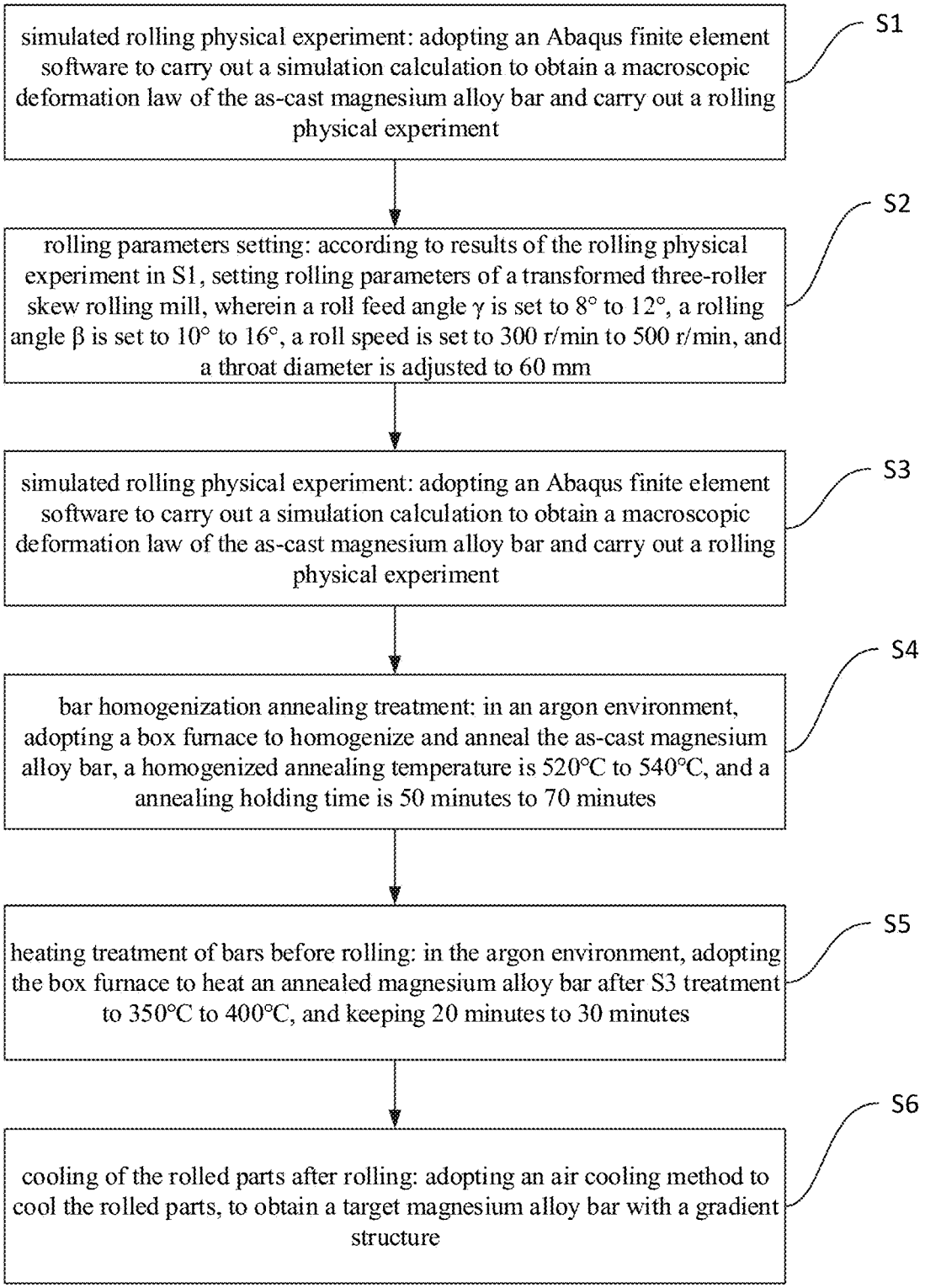
FIG. 1 is a process flow chart of corrugated skew rolling preparation method of magnesium alloy bar with gradient structure of the present disclosure.
Figure 2:
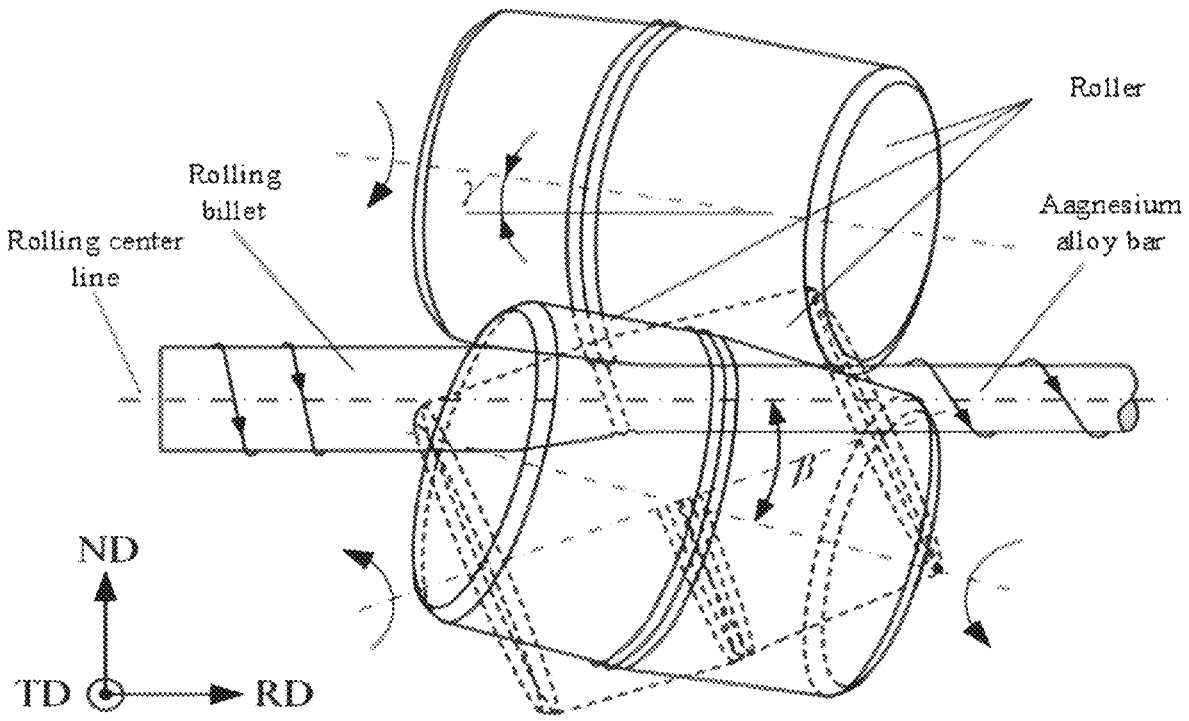
FIG. 2 is an assembly diagram of a corrugated radial shear rolling model constructed based on an Abaqus finite element software of the present disclosure.
Figure 3:
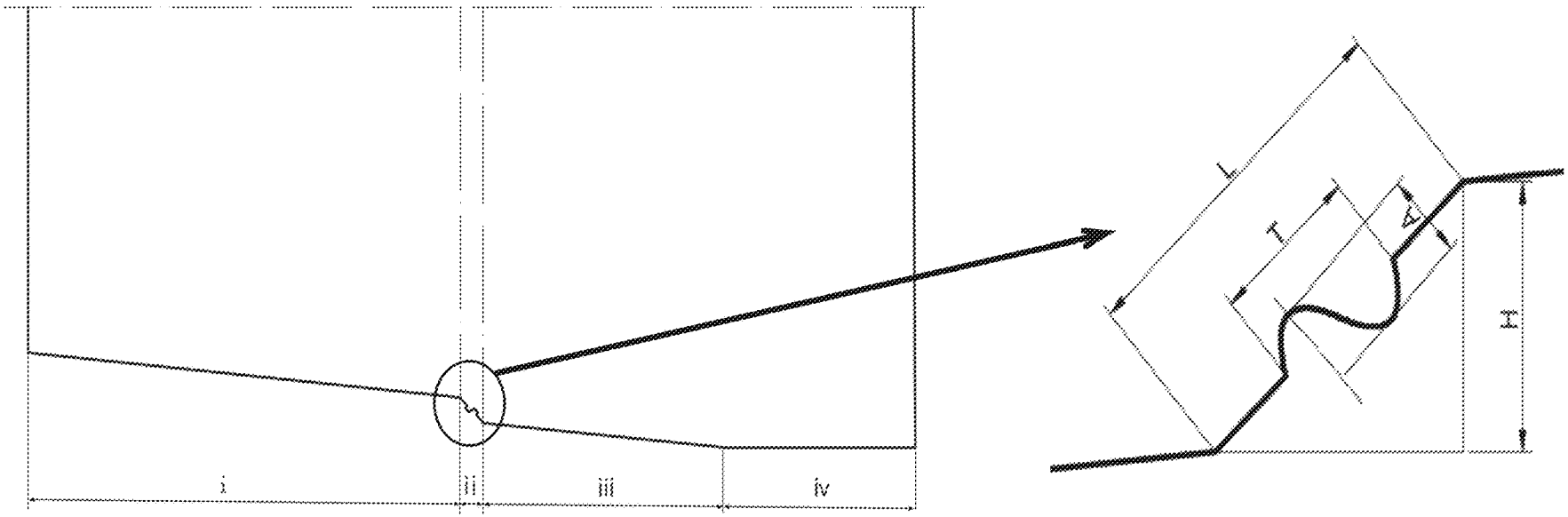
FIG. 3 is a schematic diagram of the deformation zone and corrugated curve of a three-roller skew rolling of the present disclosure.

As shown in FIG. 1 to FIG. 3, a corrugated skew rolling preparation method of a magnesium alloy bar with a gradient structure, adopts a three-roller skew rolling mill, adding a corrugated curve to a flat roll rolling section of the three-roller skew rolling mill to form a corrugated roll. And a period length T of the corrugated curve is less than a width L of the flat roll rolling section, where the corrugated curve is sinusoidal curve, and the corrugated curve of the three roller are the same, and an amplitude A of the corrugated curve that added to the flat roll rolling section is guaranteed to skip exceeding a maximum height H of the flat roll rolling section. The billet used is as-cast AZ31 magnesium alloy bar, and original materials by mass ratio are as follows: Al 2.3% to 2.5%, Zn 0.5% to 1.5%, Mn 0.1% to 0.15%, Si≤0.15%, Cu≤0.15%, Fe≤0.15%, an Mg as equation, and the total mass fraction of unavoidable impurities is not more than 0.6%. Based on the above as-cast AZ31 magnesium alloy bar and transformed three-roller skew rolling mill, steps of the preparation method are as follows:

S1, simulated rolling physical experiment: adopting Abaqus finite element software to carry out simulation calculation to obtain the macroscopic deformation law of magnesium alloy bar and carry out a rolling physical experiment;

S2, rolling parameters setting: according to results of the rolling physical experiment in S1, setting rolling parameters of a transformed three-roller skew rolling mill, wherein a roll feed angle $\gamma$ is set to 8° to 12°, a rolling angle $\beta$ is set to 6° to 10°, a roll speed is set to 300 r/min to 500 r/min, and a throat diameter is adjusted to 60 mm;

S3, bar homogenization annealing treatment: in an argon environment, adopting a box furnace to homogenize and anneal the as-cast magnesium alloy bar, a homogenized annealing temperature is 520° C. to 540° C., and a annealing holding time is 50 minutes to 70 minutes;

S4, heating treatment of bars before rolling: in the argon environment, adopting the box furnace to heat an annealed AZ31 magnesium alloy bar after S3 treatment to 350° C. to 400° C., and keeping 20 minutes to 30 minutes;

S5, three-roller skew mill rolling: sending the annealed magnesium alloy bar treated by S4 to the three-roller skew rolling mill for rolling, to obtain rolled parts;

S6, cooling of the rolled parts after rolling: adopting an air cooling method to cool the rolled parts after S5 rolling, to obtain a target magnesium alloy bar with a gradient structure.

In the embodiment 1, a preferably homogenized annealing temperature of S3 is 530° C. and a preferably annealing holding time parameter of S3 to 60 minutes.

In the embodiment 1, in Si, the simulated rolling physical experiment includes the following steps:

S1.1, establishing a finite element model: in the Abaqus finite element software, replacing all three rolling flat rolls in the flat roll rolling section of the three-roller skew rolling mill with corrugated rolls, wherein the corrugated curves on the corrugated rolls are sinusoidal curves, and the three corrugated rolls are equidistant interval distributed around a rolling center line, where the roll feed angle $\gamma$ is 8° to 12°, the rolling angle $\beta$ is 6° to 10°;

S1.2, simulated rolling: a rolling billet is the annealed AZ31 magnesium alloy bar, inputting the rolling parameters, which are obtained from thermal simulation compression, into the Abaqus finite element software, defining a contact type between the corrugated roll and the annealed magnesium alloy bar as rigid-flexible contact, setting an initial rolling temperature at 350° C. to 400° C., the roll speed at 300 r/min to 500 r/min, a bar feed speed at 10 mm/s to 15 mm/s and a roll temperature is room temperature, and the bar mesh is divided into C3D8R mesh cells, adopting a thermodynamic coupling explicit dynamic analysis to simulate the finite element model;

S1.3, rolling parameters extraction: selecting three tracking points from the center to the surface of the magnesium alloy bar after simulated rolling, and a r/R of the three tracking points are 0.1, 0.5 and 0.9 respectively, where R represents the radius of the magnesium alloy bar after rolling and r represents the distance between the tracking points and the rolling center line; extracting values of equivalent plastic strain, temperature values, values of shear stress and values of shear strain of the three tracking points to obtain the evolution law of the magnesium alloy bar during a process of corrugated rolls rolling;

S1.4, orthogonal experiment: to ensure that other rolling parameters remain unchanged, by setting the corrugated roll and flat roll respectively to simulate the orthogonal experiment; and comparing the distribution difference of the values of equivalent plastic strain, the temperature values, the values of shear stress and the values of the shear strain of the as-cast AZ31 magnesium alloy bar during the process of corrugated roll rolling and flat roll rolling, respectively.

To be noted, in S5 rolling and S1.2 simulated rolling, a radius depression rate of the AZ31 magnesium alloy bar treated by S4 and annealed AZ31 magnesium alloy bar is set to 5% to 8%.

Embodiment 2

A second embodiment provides a corrugated skew rolling preparation method of magnesium alloy bar with gradient structure, adopts a three-roller skew rolling mill, adding the corrugated curve to a flat roll rolling section of the three-roller skew rolling mill to form a corrugated roll, and a period length T of the corrugated curves is less than a width L of the flat roll rolling section, where the corrugated curves are sinusoidal curves, and the corrugated curves of the three rolling flat rolls are the same, and an amplitude A of the corrugated curves added to the flat roll rolling section is guaranteed to skip exceeding a maximum height H of the flat roll rolling section. The billet used is as-cast AZ31 magnesium alloy bar, and original materials by mass ratio are as follows: Al 2.3% to 2.5%, Zn 0.5% to 1.5%, Mn 0.1% to 0.15%, Si≤0.15%, Cu≤0.15%, Fe≤0.15%, the remaining components are Mg, and the total mass fraction of unavoidable impurities is not more than 0.6%. Based on the above as-cast AZ31 magnesium alloy bar and transformed three-roller skew rolling mill, steps of the preparation method are as follows:

S1, simulated rolling physical experiment: adopting Abaqus finite element software to carry out simulation calculation to obtain the macroscopic deformation law of magnesium alloy bar and carry out a rolling physical experiment;

S2, rolling parameters setting: according to results of the rolling physical experiment in S1, setting rolling parameters of a transformed three-roller skew rolling mill, wherein a roll feed angle γ is set to 8°, a rolling angle β is set to 6°, a roll speed is set to 300 r/min, and a throat diameter is adjusted to 60 mm;

S3, bar homogenization annealing treatment: in an argon environment, adopting a box furnace to homogenize and anneal the as-cast magnesium alloy bar, a homogenized annealing temperature is 518° C., and a annealing holding time is 48 minutes;

S4, heating treatment of bars before rolling: in the argon environment, adopting the box furnace to heat an annealed AZ31 magnesium alloy bar after S3 treatment to 348° C., and keeping 20 minutes;

S5, three-roller skew mill rolling: sending the annealed magnesium alloy bar treated by S4 to the three-roller skew rolling mill for rolling, to obtain rolled parts;

S6, cooling of the rolled parts after rolling: adopting an air cooling method to cool the rolled parts after S5 rolling, to obtain a target magnesium alloy bar with a gradient structure.

In the above implementation, we set a homogenized annealing temperature parameter of S3 to 518° C. and a annealing holding time parameter of S3 to 48 minutes.

In the embodiment, in Si, the simulated rolling physical experiment includes the following steps:

S1.1, establishing a finite element model: in Abaqus finite element software, replacing all three rolling flat rolls in the flat roll rolling section of the three-roller skew rolling mill with corrugated rolls, wherein the corrugated curves on the corrugated rolls are sinusoidal curves, and the three corrugated rolls are equidistant interval distributed around a rolling center line, where the roll feed angle γ is 8°, the rolling angle β is 6°;

S1.2, simulated rolling: a rolling billet is the annealed AZ31 magnesium alloy bar, inputting the rolling parameters, which are obtained from thermal simulation compression, into the Abaqus finite element software, defining a contact type between the corrugated roll and the annealed magnesium alloy bar as rigid-flexible contact, setting an initial rolling temperature at 350° C., the roll speed at 298 r/min, a bar feed speed at 10 mm/s and a roll temperature is room temperature, and the bar mesh is divided into C3D8R mesh cells, adopting a thermodynamic coupling explicit dynamic analysis to simulate the finite element model;

S1.3, rolling parameters extraction: selecting three tracking points from the center to the surface of the magnesium alloy bar after simulated rolling, and a r/R of the three tracking points are 0.1, 0.5 and 0.9 respectively, wherein R represents the radius of the magnesium alloy bar after rolling and r represents the distance between the tracking points and the rolling center line; extracting values of equivalent plastic strain, temperature values, values of shear stress and values of shear strain of the three tracking points to obtain the evolution law of the magnesium alloy bar during a process of corrugated rolls rolling;

S1.4, orthogonal experiment: to ensure that other rolling parameters remain unchanged, by setting the corrugated roll and flat roll respectively to simulate the orthogonal experiment; and compare the distribution difference of the values of equivalent plastic strain, the temperature values, the values of shear stress and the values of the shear strain of the as-cast AZ31 magnesium alloy bar during the process of corrugated roll rolling and flat roll rolling, respectively.

To be noted, in S5 rolling and S1.2 simulated rolling, a radius depression rate of the AZ31 magnesium alloy bar treated by S4 and annealed AZ31 magnesium alloy bar is set to 5%.

Embodiment 3

The third embodiment provides a corrugated skew rolling preparation method of magnesium alloy bar with gradient structure, adopts a three-roller skew rolling mill, adding the corrugated curve to a flat roll rolling section of the three-roller skew rolling mill to form a corrugated roll, and a period length T of the corrugated curves is less than a width L of the flat roll rolling section, where the corrugated curves are sinusoidal curves, and the corrugated curves of the three rolling flat rolls are the same, and an amplitude A of the corrugated curves added to the flat roll rolling section is guaranteed to skip exceeding a maximum height H of the flat roll rolling section. The billet used is as-cast AZ31 magnesium alloy bar, and original materials by mass ratio are as follows: Al:2.3% to 2.5%, Zn:0.5% to 1.5%, Mn:0.1% to 0.15%, Si:≤0.15%, Cu:≤0.15%, Fe:≤0.15%, the remaining components are Mg, and the total mass fraction of unavoidable impurities is not more than 0.6%. Based on the above as-cast AZ31 magnesium alloy bar and transformed three-roller skew rolling mill, steps of the preparation method are as follows:

S1, simulated rolling physical experiment: adopting Abaqus finite element software to carry out simulation calculation to obtain the macroscopic deformation law of magnesium alloy bar and carry out a rolling physical experiment;

S2, rolling parameters setting: according to results of the rolling physical experiment in Si, setting rolling parameters of a transformed three-roller skew rolling mill, wherein a roll feed angle γ is set to 10°, a rolling angle β is set to 8°, a roll speed is set to 400 r/min, and a throat diameter is adjusted to 60 mm;

S3, bar homogenization annealing treatment: in an argon environment, adopting a box furnace to homogenize and anneal the as-cast magnesium alloy bar, a homogenized annealing temperature is 530° C., and a annealing holding time is 60 minutes;

S4, heating treatment of bars before rolling: in the argon environment, adopting the box furnace to heat an annealed AZ31 magnesium alloy bar after S3 treatment to 375° C., and keeping 25 minutes;

S5, three-roller skew mill rolling: sending the annealed magnesium alloy bar treated by S4 to the three-roller skew rolling mill for rolling, to obtain rolled parts;

S6, cooling of the rolled parts after rolling: adopting an air cooling method to cool the rolled parts after S5 rolling, to obtain a target magnesium alloy bar with a gradient structure.

In the above implementation, we set a homogenized annealing temperature parameter of S3 to 530° C. and a annealing holding time parameter of S3 to 60 minutes.

In the embodiment, in S1, the simulated rolling physical experiment includes the following steps:

S1.1, establishing a finite element model: in Abaqus finite element software, replacing all three rolling flat rolls in the flat roll rolling section of the three-roller skew rolling mill with corrugated rolls, wherein the corrugated curves on the corrugated rolls are sinusoidal curves, and the three corrugated rolls are equidistant interval distributed around a rolling center line, where the roll feed angle γ is 10°, the rolling angle β is 8°;

S1.2, simulated rolling: a rolling billet is the annealed AZ31 magnesium alloy bar, inputting the rolling parameters, which are obtained from thermal simulation compression, into the Abaqus finite element software, defining a contact type between the corrugated roll and the annealed magnesium alloy bar as rigid-flexible contact, setting an initial rolling temperature at 375° C., the roll speed at 400 r/min, a bar feed speed at 12.5 mm/s and a roll temperature is room temperature, and the bar mesh is divided into C3D8R mesh cells, adopting a thermodynamic coupling explicit dynamic analysis to simulate the finite element model;

S1.3, rolling parameters extraction: selecting three tracking points from the center to the surface of the magnesium alloy bar after simulated rolling, and a r/R of the three tracking points are 0.1, 0.5 and 0.9 respectively, wherein R represents the radius of the magnesium alloy bar after rolling and r represents the distance between the tracking points and the rolling center line; extracting values of equivalent plastic strain, temperature values, values of shear stress and values of shear strain of the three tracking points to obtain the evolution law of the magnesium alloy bar during a process of corrugated rolls rolling;

S1.4, orthogonal experiment: to ensure that other rolling parameters remain unchanged, by setting the corrugated roll and flat roll respectively to simulate the orthogonal experiment; and compare the distribution difference of the values of equivalent plastic strain, the temperature values, the values of shear stress and the values of the shear strain of the as-cast AZ31 magnesium alloy bar during the process of corrugated roll rolling and flat roll rolling, respectively.

To be noted, in S5 rolling and S1.2 simulated rolling, a radius depression rate of the AZ31 magnesium alloy bar treated by S4 and annealed AZ31 magnesium alloy bar is set to 6.5%.

Embodiment 4

The fourth embodiment provides a corrugated skew rolling preparation method of magnesium alloy bar with gradient structure, adopts a three-roller skew rolling mill, adding the corrugated curve to a flat roll rolling section of the three-roller skew rolling mill to form a corrugated roll, and a period length T of the corrugated curves is less than a width L of the flat roll rolling section, where the corrugated curves are sinusoidal curves, and the corrugated curves of the three rolling flat rolls are the same, and an amplitude A of the corrugated curves added to the flat roll rolling section is guaranteed to skip exceeding a maximum height H of the flat roll rolling section. The billet used is as-cast AZ31 magnesium alloy bar, and original materials by mass ratio are as follows: Al 2.3% to 2.5%, Zn 0.5% to 1.5%, Mn 0.1% to 0.15%, Si≤0.15%, Cu≤0.15%, Fe≤0.15%, the remaining components are Mg, and the total mass fraction of unavoidable impurities is not more than 0.6%. Based on the above as-cast AZ31 magnesium alloy bar and transformed three-roller skew rolling mill, steps of the preparation method are as follows:

S1, simulated rolling physical experiment: adopting Abaqus finite element software to carry out simulation calculation to obtain the macroscopic deformation law of magnesium alloy bar and carry out a rolling physical experiment;

S2, rolling parameters setting: according to results of the rolling physical experiment in S1, setting rolling parameters of a transformed three-roller skew rolling mill, wherein a roll feed angle γ is set to 12°, a rolling angle β is set to 10°, a roll speed is set to 503 r/min, and a throat diameter is adjusted to 60 mm;

S3, bar homogenization annealing treatment: in an argon environment, adopting a box furnace to homogenize and anneal the as-cast magnesium alloy bar, a homogenized annealing temperature is 540° C., and a annealing holding time is 70 minutes;

S4, heating treatment of bars before rolling: in the argon environment, adopting the box furnace to heat an annealed AZ31 magnesium alloy bar after S3 treatment to 403° C., and keeping 30 minutes;

S5, three-roller skew mill rolling: sending the annealed magnesium alloy bar treated by S4 to the three-roller skew rolling mill for rolling, to obtain rolled parts;

S6, cooling of the rolled parts after rolling: adopting an air cooling method to cool the rolled parts after S5 rolling, to obtain a target magnesium alloy bar with a gradient structure.

In the above implementation, we set a homogenized annealing temperature parameter of S3 to 540° C. and a annealing holding time parameter of S3 to 70 minutes.

In the embodiment, in Si, the simulated rolling physical experiment includes the following steps:

S1.1, establishing a finite element model: in Abaqus finite element software, replacing all three rolling flat rolls in the flat roll rolling section of the three-roller skew rolling mill with corrugated rolls, wherein the corrugated curves on the corrugated rolls are sinusoidal curves, and the three corrugated rolls are equidistant interval distributed around a rolling center line, where the roll feed angle $\gamma$ is 12°, the rolling angle $\beta$ is 10°;

S1.2, simulated rolling: a rolling billet is the annealed AZ31 magnesium alloy bar, inputting the rolling parameters, which are obtained from thermal simulation compression, into the Abaqus finite element software, defining a contact type between the corrugated roll and the annealed magnesium alloy bar as rigid-flexible contact, setting an initial rolling temperature at 403° C., the roll speed at 500 r/min, a bar feed speed at 15 mm/s and a roll temperature is room temperature, and the bar mesh is divided into C3D8R mesh cells, adopting a thermodynamic coupling explicit dynamic analysis to simulate the finite element model;

S1.3, rolling parameters extraction: selecting three tracking points from the center to the surface of the magnesium alloy bar after simulated rolling, and a r/R of the three tracking points are 0.1, 0.5 and 0.9 respectively, wherein R represents the radius of the magnesium alloy bar after rolling and r represents the distance between the tracking points and the rolling center line; extracting values of equivalent plastic strain, temperature values, values of shear stress and values of shear strain of the three tracking points to obtain the evolution law of the magnesium alloy bar during a process of corrugated rolls rolling;

S1.4, orthogonal experiment: to ensure that other rolling parameters remain unchanged, by setting the corrugated roll and flat roll respectively to simulate the orthogonal experiment; and compare the distribution difference of the values of equivalent plastic strain, the temperature values, the values of shear stress and the values of the shear strain of the as-cast AZ31 magnesium alloy bar during the process of corrugated roll rolling and flat roll rolling, respectively.

To be noted, in S5 rolling and S1.2 simulated rolling, a radius depression rate of the AZ31 magnesium alloy bar treated by S4 and annealed AZ31 magnesium alloy bar is set to 8%.

Taking the initial diameter of the bar of 65 mm to 75 mm and the length of 200 mm to 500 mm as an example, we illustrate the preparation process of magnesium alloy bar with gradient structure through a three-roller corrugated skew rolling mill rolling AZ31 magnesium alloy bar. Putting the bar into a heating furnace filled with argon gas to preheat to 350° C. to 400° C., and holding for 20 minutes to 30 minutes. Adjusting the spatial position of the roll and setting the roll speed to 300 r/min to 500 r/min. Air cooling the bar after the completion of rolling to obtain the magnesium alloy bar with gradient structure. Sampling the bar from surface layer to heart after rolling, and observing the grain distribution and flow line of the bar to obtain the gradient distribution microstructure.

Figure 4:
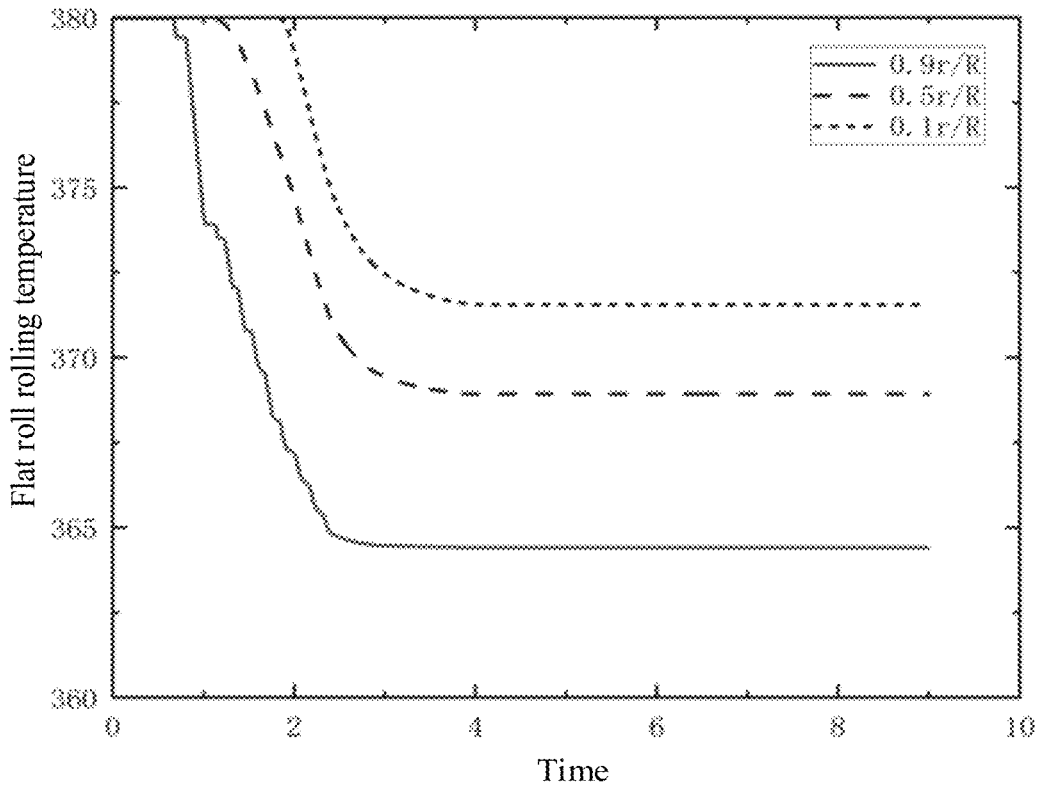
FIG. 4 is a temperature diagram of a flat roll rolling in an embodiment of the present disclosure.
Figure 5:
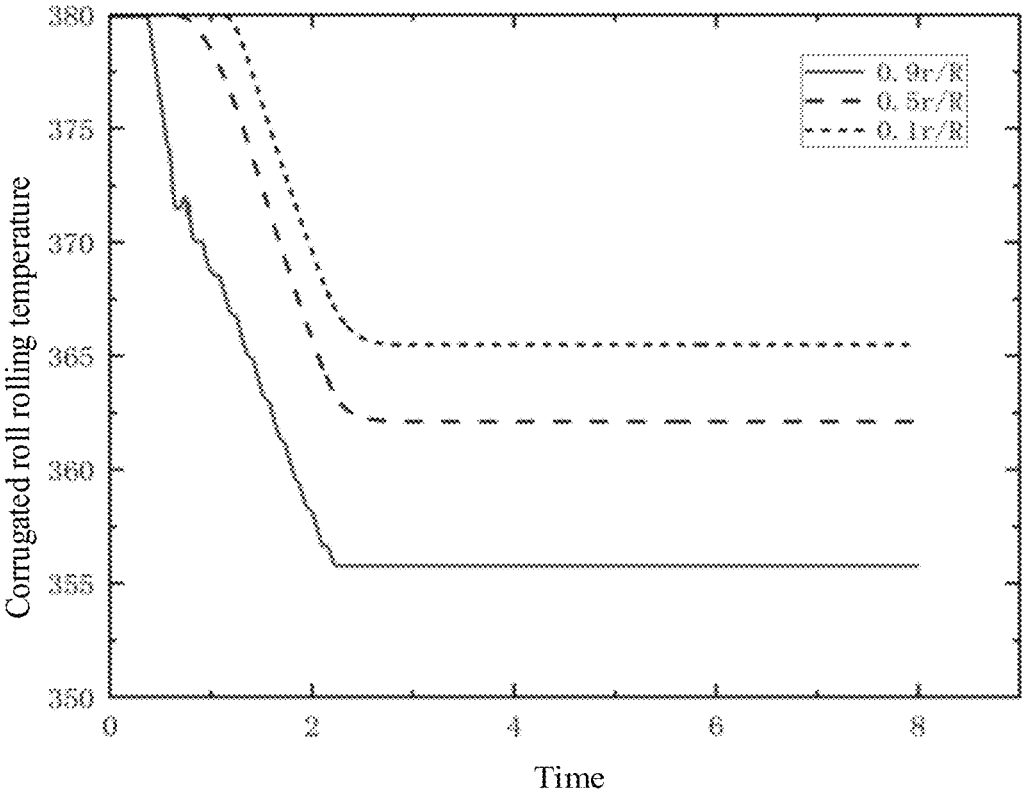
FIG. 5 is a temperature diagram of a corrugated roll rolling in an embodiment of the present disclosure.
Figure 6:
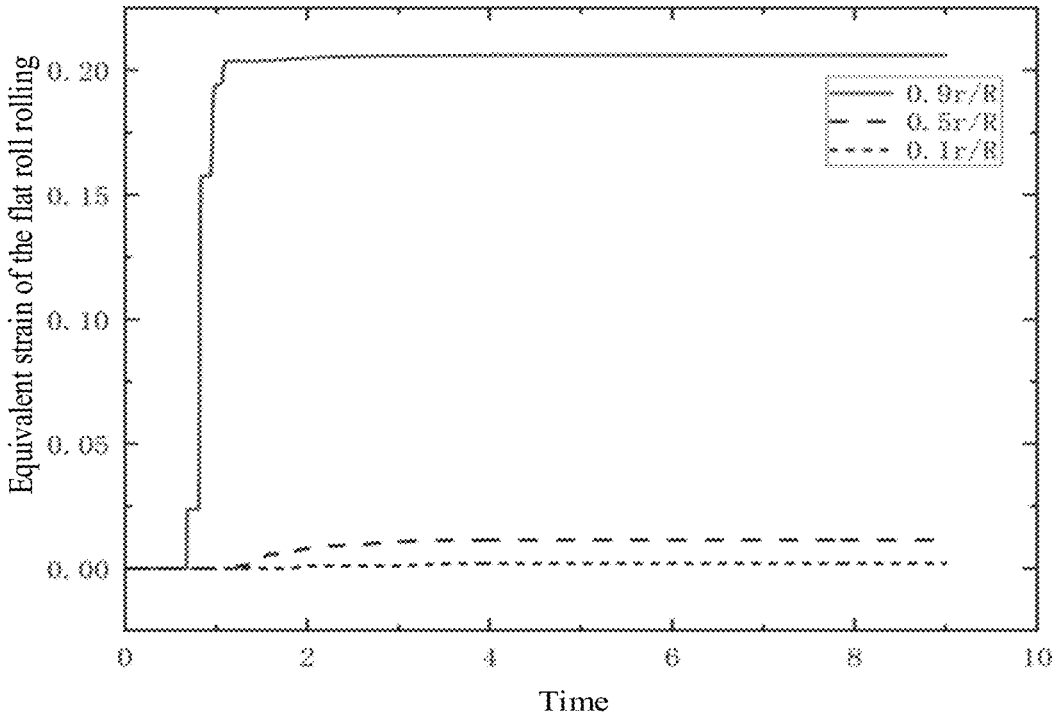
FIG. 6 is an equivalent strain diagram of the flat roll rolling in the embodiment of the present disclosure.
Figure 7:
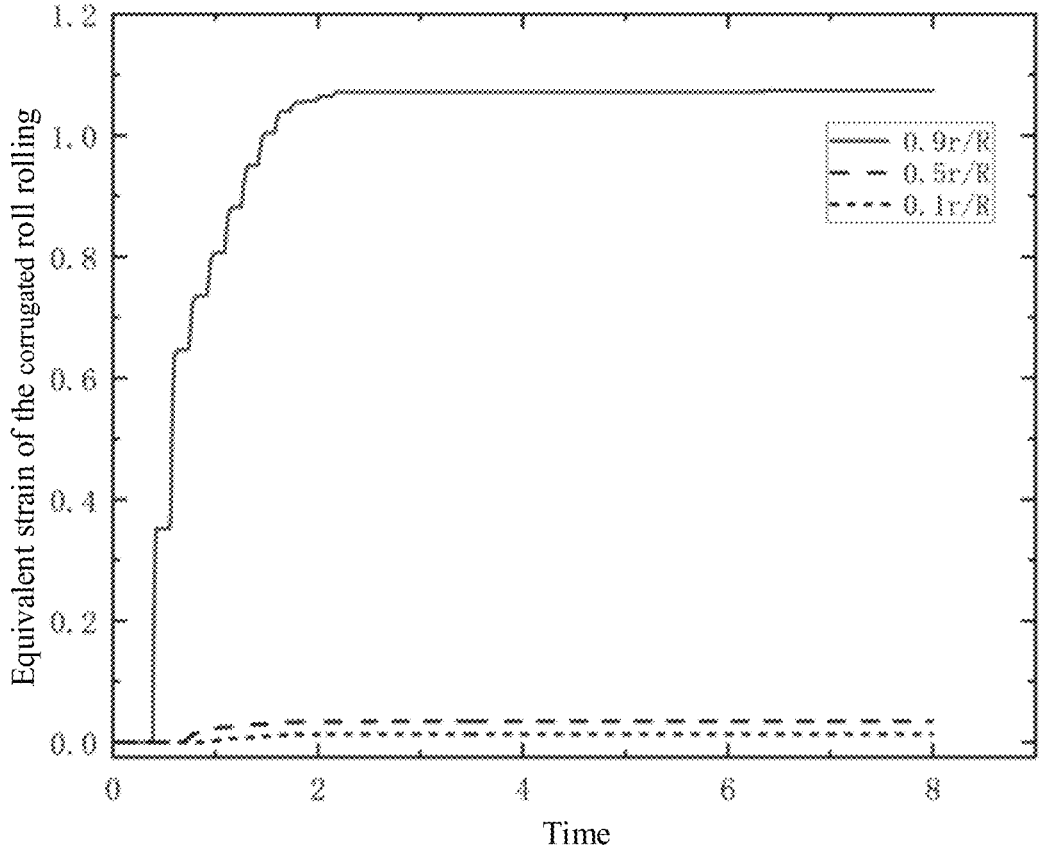
FIG. 7 is an equivalent strain diagram of the corrugated roll rolling in the embodiment of the present disclosure.

As shown in FIG. 4 to FIG. 7, comparison diagram of two datas of the corrugated roll rolling and the flat roll rolling all select three tracking points from the rolling center to the surface after rolling (corresponding r/R is 0.1, 0.5 and 0.9, respectively, R represents the radius of the rolled parts, and r represents the distance between the tracking points and the rolling center line), and analyze the relationship between temperature and equivalent strain of the three tracking points over time during the rolling process. Refer to FIG. 4 and FIG. 5, comparing the temperature change diagram of the flat rolling and the corrugated rolling, compared with that of flat roll rolling, the contacting area of the corrugated roll and the bar is larger, and the temperature decreases faster. In stable rolling stage, the temperature gradient change of corrugated roll rolling produced in the radial of the bar is more obvious than that of flat roll rolling. Refer to FIG. 6 and FIG. 7, it is obvious to be seen from the comparison diagrams that the surface equivalent strain of corrugated roll rolling is about 6 times that of flat roll rolling, and the strain in the middle and center is much larger than that of flat roll rolling. Compared with flat roll rolling, corrugated roll rolling has a more obvious law of equivalent strain gradient distribution. Due to the rapid heat dissipation of magnesium alloy, the magnesium alloy bar directly contacts with the roll with lower temperature during the rolling process, and the roll absorbs more heat, resulting in a continuous drop of the bar temperature in the biting section. As the temperature difference between the bar surface to the heart and the roll decreases successively, the trend of the temperature drop from the surface to the heart decreases gradually.

Figure 8:
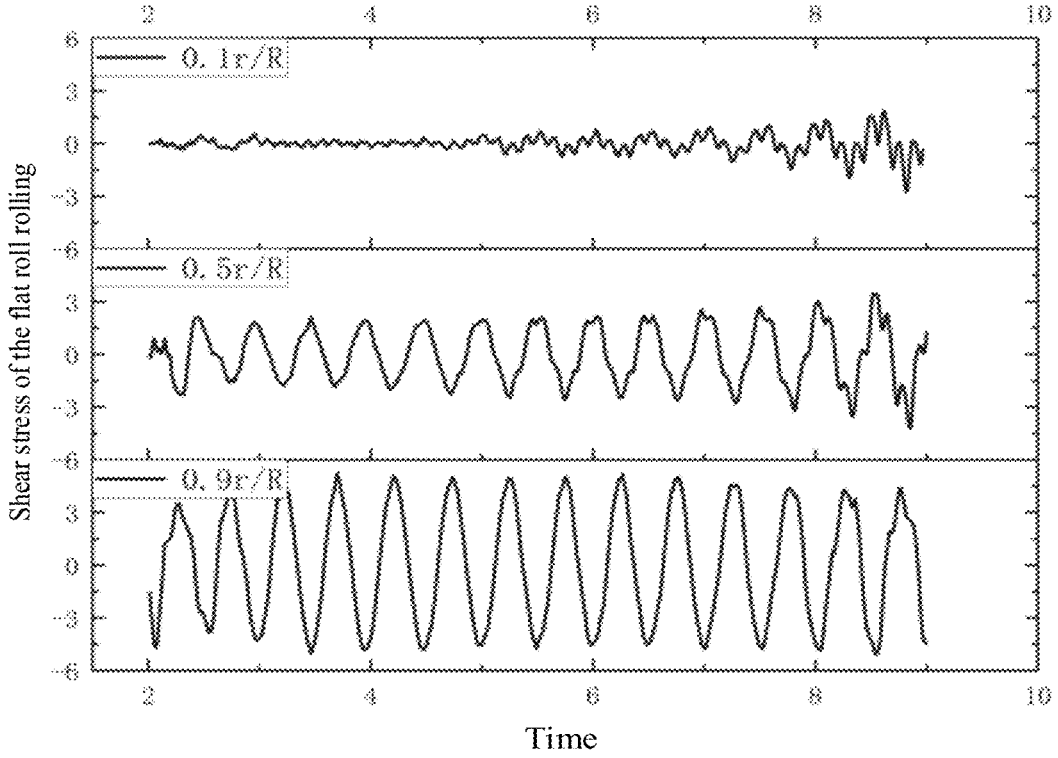
FIG. 8 is a shear stress diagram of the flat roll rolling in the embodiment of the present disclosure.
Figure 9:
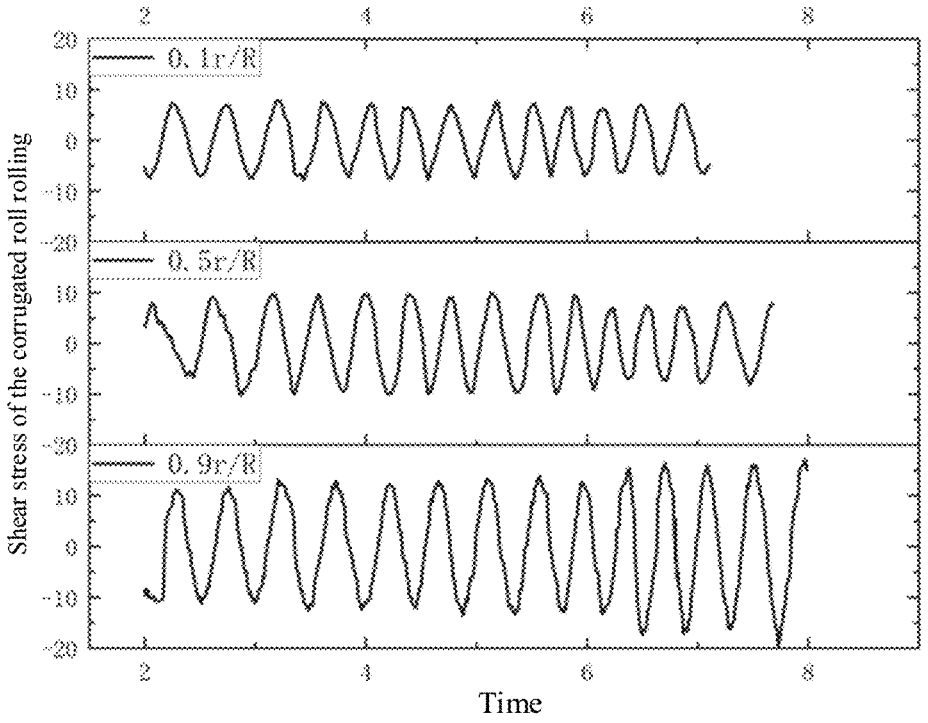
FIG. 9 is a shear stress diagram of the corrugated roll rolling in the embodiment of the present disclosure.
Figure 10:
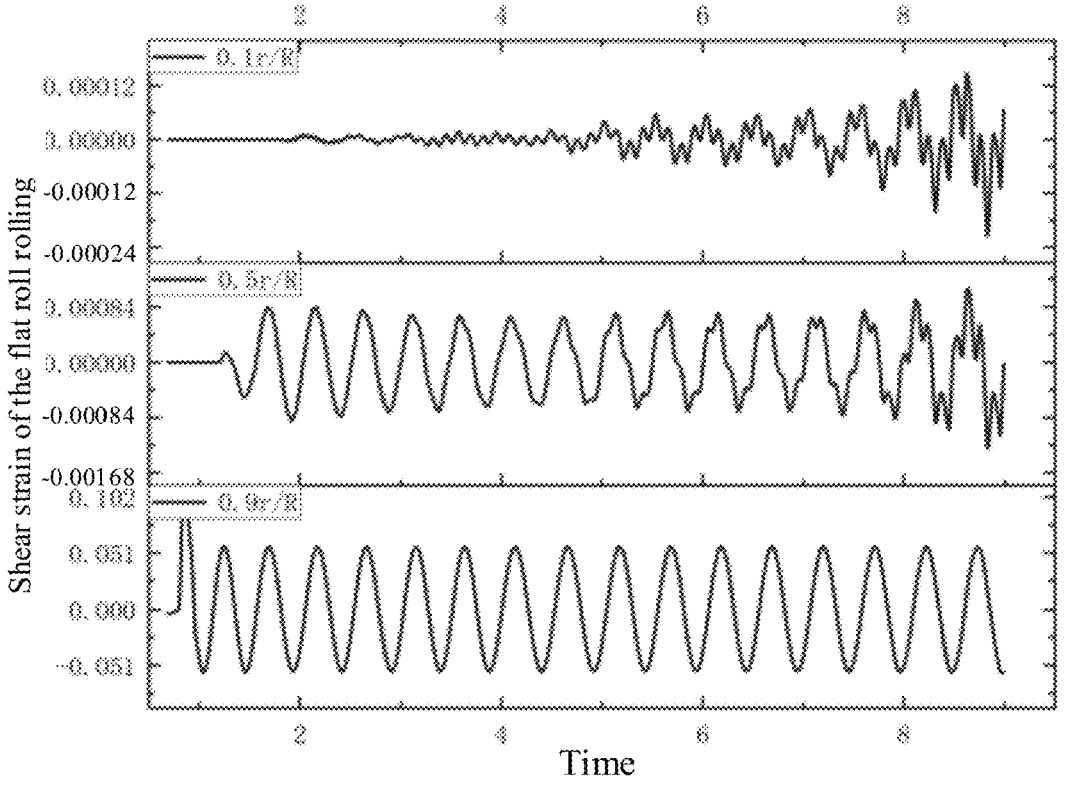
FIG. 10 is a shear strain diagram of the flat roll rolling in the embodiment of the present disclosure.
Figure 11:
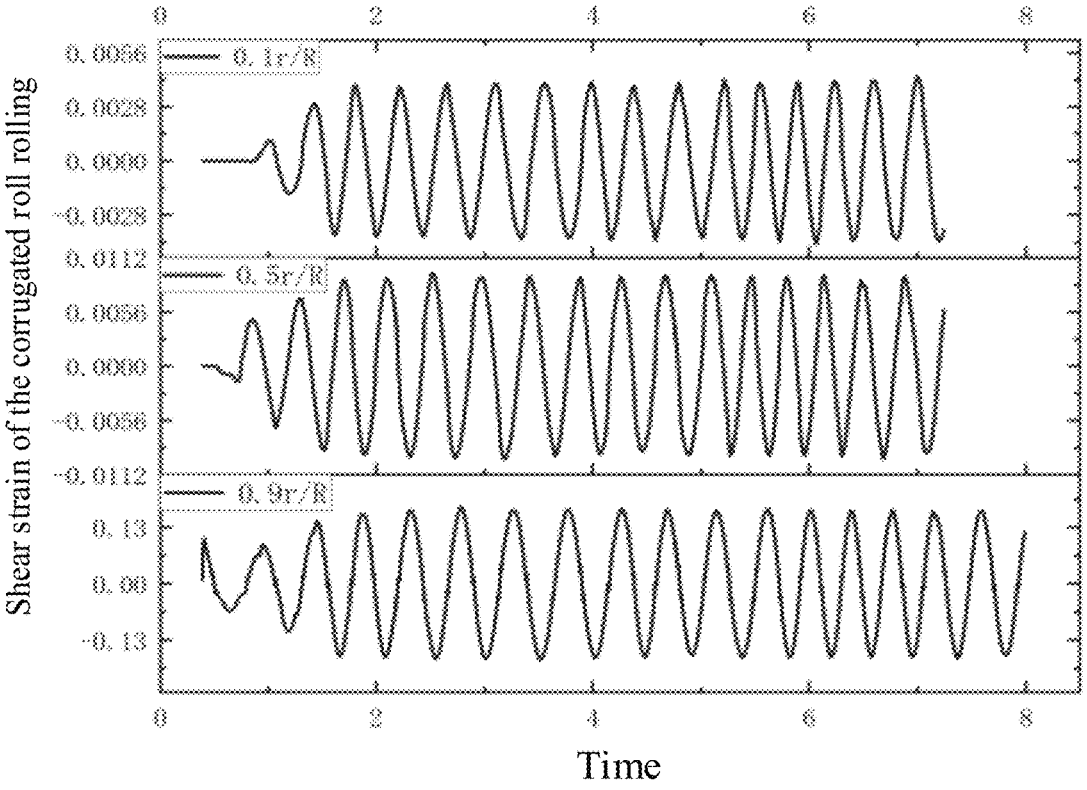
FIG. 11 is a shear strain diagram of the corrugated roll rolling in the embodiment of the present disclosure.

As shown in FIG. 8 and FIG. 9, it can be seen from the two sets of shear stress comparison diagrams of corrugated roll rolling and flat roll rolling that corrugated rolling has greater shear stress than flat rolling, which is conducive to activating more slip system start. As shown in FIG. 10 and FIG. 11, it can be seen from the shear strain comparison diagrams of corrugated roll rolling and flat roll rolling that the gradient change of the shear strain of corrugated rolling is much larger than that of flat roll rolling from the surface to the heart of the magnesium alloy bar, making the magnesium alloy bar obtain a greater strain gradient. At the same time, making magnesium alloy bar carry out the plastic deformation under two deformation mechanisms of slip and twin.

Figure 12:
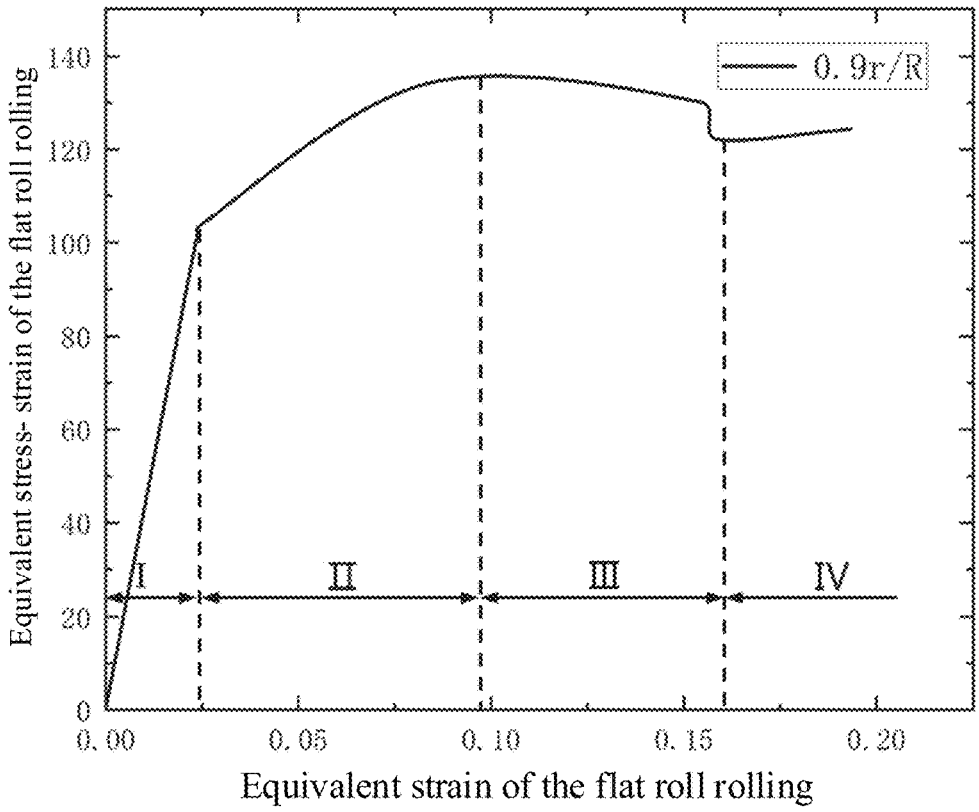
FIG. 12 is an equivalent stress-strain diagram of the flat roll rolling in the embodiment of the present disclosure.
Figure 13:
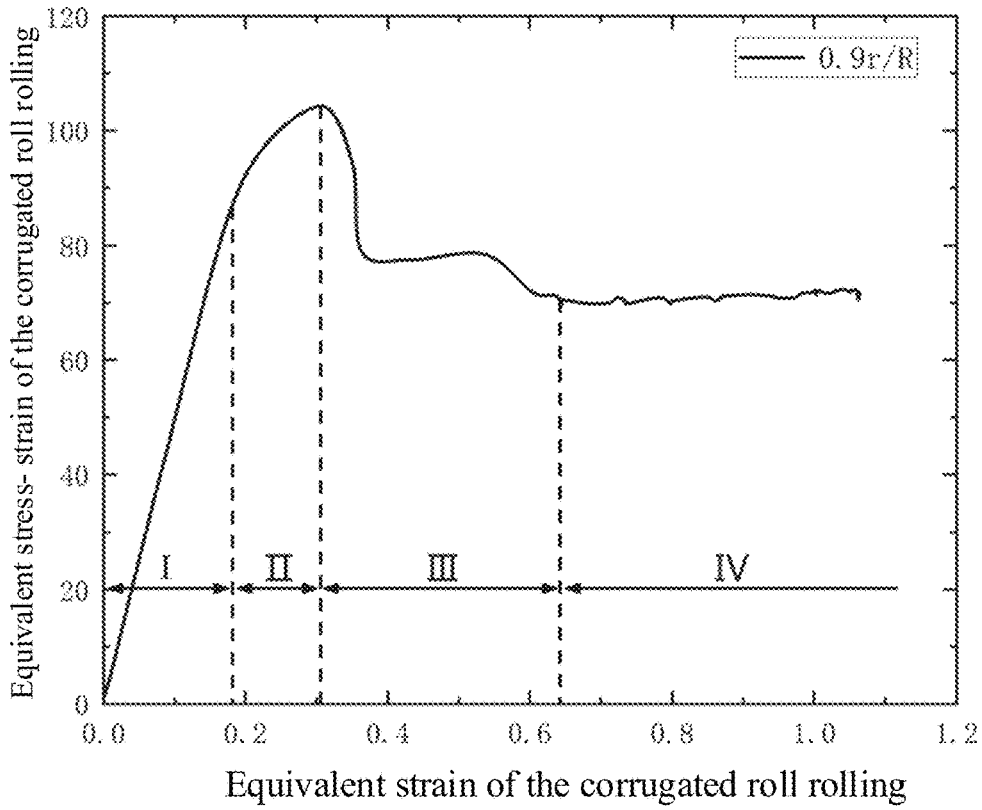
FIG. 13 is an equivalent stress-strain diagram of the corrugated roll rolling in the embodiment of the present disclosure.

As shown in FIG. 12 and FIG. 13, from the equivalent stress-strain comparison diagram of magnesium alloy bar after corrugated roll and flat roll rolling, it can be seen that the stress and strain curves can generally be divided into four stages: work hardening stage (I), transition stage (II), softening stage (III), and steady state stage (IV). In the work hardening stage, the stress of flat roll rolling increases rapidly with the increase of strain, the strength of the bar is higher in this stage, but the plasticity of the bar is reduced after rolling. The stress change of corrugated roll rolling in work hardening stage is more gentle than that of flat roll. Then the stress continues to increase and decreases after reaching the peak, and the corrugated roll drops more than the flat roll. This is because the dynamic recrystallization softening effect of corrugated roll is stronger than that of flat roll rolling. In the final stage, the stress and strain curves tend to be level, and the hardening and softening mechanisms reach equilibrium. Due to the few strain variable and short strain time of flat roll rolling, resulting in uneven deformation, which causes work hardening, uneven tissue and other problems, affecting the subsequent processing.

Figure 14:
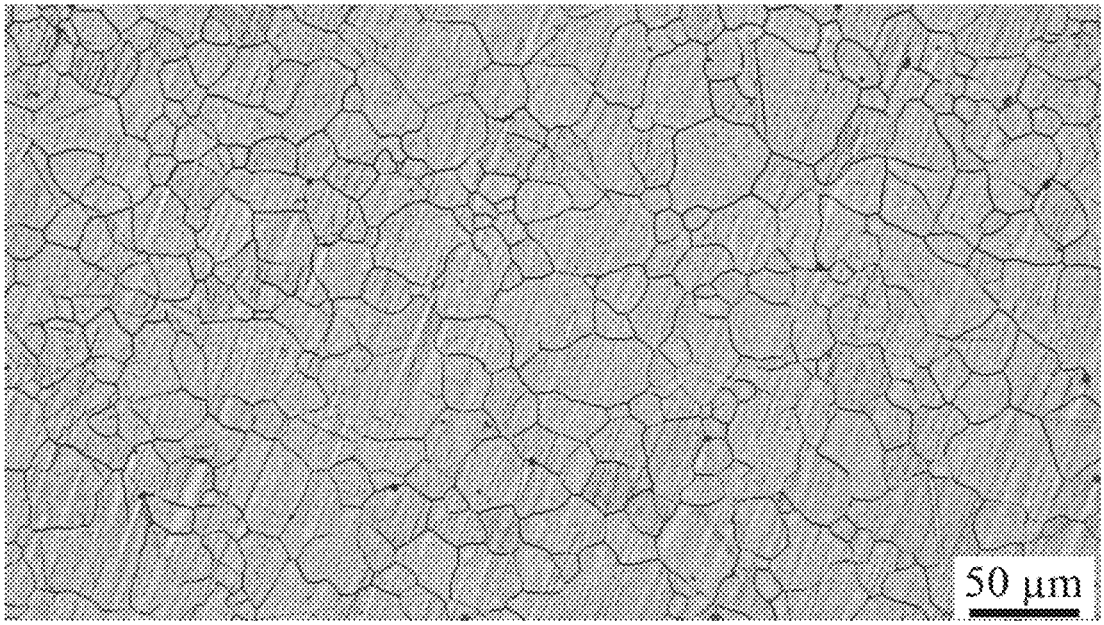
FIG. 14 is a microscopic grain metallography diagram of a surface layer of magnesium alloy bar prepared by the present disclosure.
Figure 15:
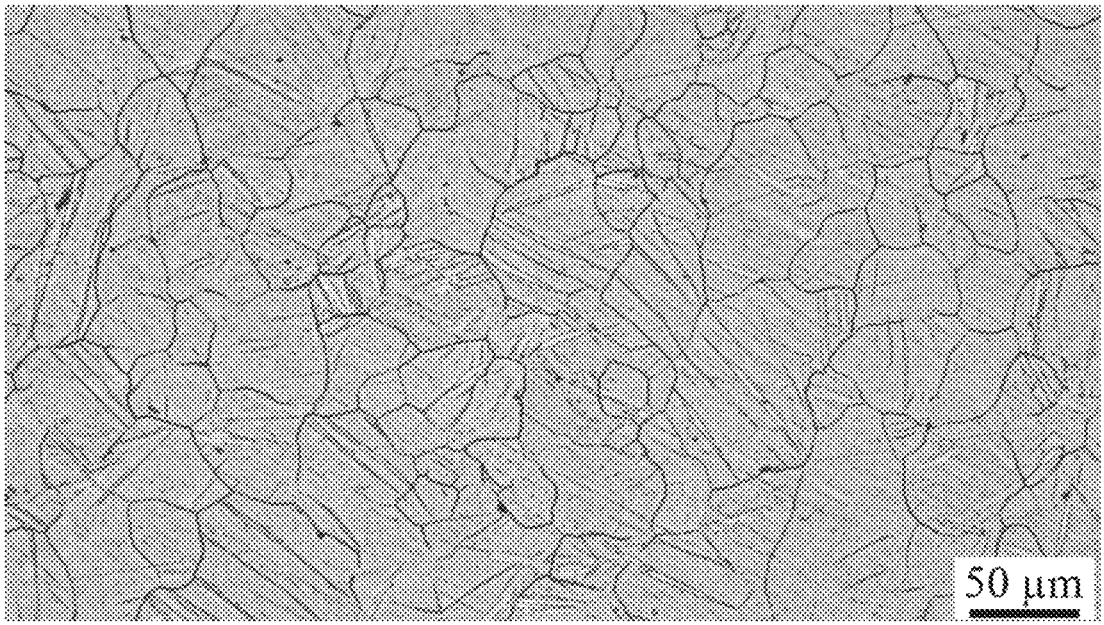
FIG. 15 is a microscopic grain metallography diagram of a middle part of magnesium alloy bar prepared by the present disclosure.
Figure 16:
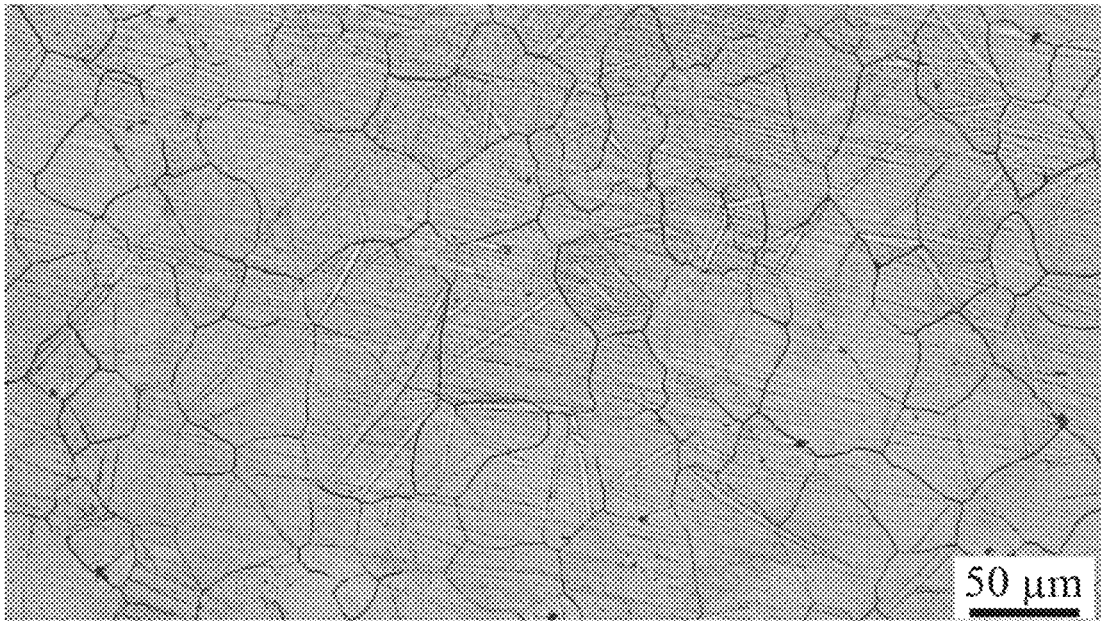
FIG. 16 is a microscopic grain metallography diagram of a centre part of magnesium alloy bar prepared by the present disclosure.

As shown in FIG. 14 to FIG. 16, the three metallographic microstructures diagrams are respectively the metallographic microstructures diagrams of the surface, middle and heart prepared by sampling from the surface to the heart along the radial direction of the end face of the rolled magnesium alloy bar. It can be seen from the three metallographic microstructures diagrams that the surface layer is subjected to the greatest stress, so the surface layer is mainly dominated by dynamic recrystallization, and a large number of pearl-shaped recrystallized grains can be obviously seen in the metallographic micrographs. As the stress deepens gradually, twin bands form in the middle and the heart. However, because the stress on the middle is much less than that on the surface, it is not enough to support the middle to continue to slip, forming the coexistence of twin bands and tiny recrystallized grains. In addition, by observing the three metallographic microstructures diagrams again, the middle is more twin bands than the heart, and more recrystallized grains than the heart. From the three metallographic microstructures comparison diagrams, it is found that the grains gradually became smaller from the heart to the surface, especially in the surface of triaxed grains, and recrystallized grains are dense and fine.

The corrugated skew rolling preparation method of magnesium alloy bar with gradient structure proposed by the present disclosure is professionally and creatively analyzed: nowadays, the corrugated roll rolling technique is widely used for the preparation of metal composite sheet and magnesium alloy sheet, and the corrugated rolling introduces local strong stress, making the local sheet obtain the repeated pressing and extrusion, the coarse grains of the original sheet are broken, and fine surface grains are obtained. Corrugated rolling is configured to obtain a better gradient structure, which promotes the grain refinement of the surface layer, improves the strength and make the ductility further improved. Research by Zhang Qinghui and Li Jianguo has showed that a good combination of strength and ductility can be induced for HCP structured materials by generating a gradient structure. In gradient structured materials, from the surface to the heart, the continuous change of grain size produces a large gradient strain with increasing depth. Later, many geometrically necessary dislocations (GND) are generated during the plastic machining to adapt to the deformation. This increase of dislocation density further increases the strength of the material; the decrease of ductility is mainly because of the increase of dislocation density in the surface layer, the decrease of dislocation mobility, and the absence of dislocation storage capacity. For the gradient structure, the coarse crystal of the heart is configured to effectively delay the premature destruction of the material by delaying the plastic deformation and improve the ductility of the material. The microstructure evolution caused by dislocation slip-twin interaction, dislocation wall generation and multiple cross twins is the main reason for the performance improvement. When corrugated roll skew rolling, the bar is rolled repeatedly under the action of complex pass shape of space structure formed by three rolls, and the corrugations added in rolling section repeatedly rub the bar surface, compared with flat roll rolling, the contact area of the bar surface is larger, the rolling times are more, the rolling depth is deeper, the shear stress is greater, and it is easier to reach the critical stress of activating the slip system. At the same time, the bar obtains greater plastic deformation, which is conducive to the weakening of the texture. By this technique, the bar can obtain a greater cumulative strain and a much smaller grain size. The small bumps caused by corrugated rolling are further smoothed over the whole section of the roll, resulting in further metal flow on the bar surface. The metal of the wave crest flows into the trough, increasing the equivalent strain and refining the grain. The uniformization section of the roll further smooths the small bumps caused by corrugated rolling, making the bar surface further occur metal flow. The metal of the wave crest flows into the trough, increasing the equivalent strain and refining the grain.

The above shows and describes the main features and advantages of the present disclosure, for the technicians in the field, it is obvious that the specific embodiments of the present disclosure are not limited to the details of the exemplary embodiment of the above, and the creative ideas and design ideas of the present disclosure can be realized in other specific forms without departing from the spirit or basic features of the present disclosure, which shall be equivalent to the scope of protection disclosed in the technical solution of the present disclosure. Thus, at any point, the embodiments should be regarded as exemplary and nonrestrictive, and the scope of the present disclosure is defined by the attached claims rather than the above description, so aiming to include all changes in the present disclosure within the meaning and scope of the equivalent elements of the claims.

Moreover, it should be understood that, although this specification is described in accordance with embodiments, not each embodiment contains only one independent technical solution, and the description of the specification in this manner is only for clarity, the technicians in the field should take the specification as a whole, and the technical solution in each embodiment can also be properly combined to form other embodiments understandable by the technicians in the field.

What is claimed is:

1. A corrugated skew rolling preparation method of a magnesium alloy bar with a gradient structure, adopts a three-roller skew rolling mill, wherein, adding a corrugated curve to a flat roll rolling section of the three-roller skew rolling mill to form a corrugated roll, the billet used is as-cast magnesium alloy bar, and steps of the preparation method are as follows:

S1, simulated rolling physical experiment: adopting an Abaqus finite element software to carry out a simulation calculation to obtain a macroscopic deformation law of the as-cast magnesium alloy bar and carry out a rolling physical experiment;

S2, rolling parameters setting: according to results of the rolling physical experiment in S1, setting rolling parameters of a transformed three-roller skew rolling mill, wherein a roll feed angle $\gamma$ is set to 8° to 12°, a rolling angle $\beta$ is set to 6° to 10°, a roll speed is set to 300 r/min to 500 r/min, and a throat diameter is adjusted to 60 mm;

S3, bar homogenization annealing treatment: in an argon environment, adopting a box furnace to homogenize and anneal the as-cast magnesium alloy bar, a homogenized annealing temperature is 520° C. to 540° C., and a annealing holding time is 50 minutes to 70 minutes;

S4, heating treatment of bars before rolling: in the argon environment, adopting the box furnace to heat an annealed magnesium alloy bar after S3 treatment to 350° C. to 400° C., and keeping 20 minutes to 30 minutes;

S5, three-roller skew mill rolling: sending the annealed magnesium alloy bar treated by S4 to the three-roller skew rolling mill for rolling, to obtain rolled parts;

S6, cooling of the rolled parts after rolling: adopting an air cooling method to cool the rolled parts, to obtain a target magnesium alloy bar with a gradient structure;

wherein, in S1, the simulated rolling physical experiment comprises the following steps:

S1.1, establishing a finite element model: in the Abaqus finite element software, replacing all three rolling flat rolls in the flat roll rolling section of the three-roller skew rolling mill with corrugated rolls, wherein the corrugated curves on the corrugated rolls are sinusoidal curves, and the three corrugated rolls are equidistant interval distributed around a rolling center line, wherein the roll feed angle $\gamma$ is 8° to 12°, the rolling angle $\beta$ is 6° to 10°;

S1.2, simulated rolling: a rolling billet is the annealed magnesium alloy bar, inputting the rolling parameters, which are obtained from thermal simulation compression, into the Abaqus finite element software, defining a contact type between the corrugated roll and the annealed magnesium alloy bar as a rigid-flexible contact, setting an initial rolling temperature at 350° C. to 400° C., setting the roll speed at 300 r/min to 500 r/min, setting a bar feed speed at 10 mm/s to 15 mm/s and a roll temperature is room temperature, and the bar mesh is divided into mesh cells, adopting a thermodynamic coupling explicit dynamic analysis to simulate the finite element model;

S1.3, rolling parameters extraction: selecting three tracking points from the center to the surface of the magnesium alloy bar after the step of S1.2 simulated rolling, and a r/R of the three tracking points are 0.1, 0.5 and 0.9 respectively, wherein R represents the radius of the magnesium alloy bar after the step of S1.2 simulated rolling and r represents the distance between the tracking points and the rolling center line; extracting values of equivalent plastic strain, temperature values, values of shear stress and values of shear strain of the three tracking points to obtain an evolution law of the magnesium alloy bar during a process of corrugated rolls rolling;

S1.4, orthogonal experiment: to ensure that other rolling parameters remain unchanged, by setting the corrugated roll and flat roll respectively to simulate the orthogonal experiment; and comparing the distribution difference of the values of equivalent plastic strain, the temperature values, the values of shear stress and the values of the shear strain of the as-cast magnesium alloy bar during the process of corrugated roll rolling and flat roll rolling, respectively.

2. The corrugated skew rolling preparation method of the magnesium alloy bar with the gradient structure according to claim 1, wherein, in S1.1, the corrugated curves are added in the corrugated roll at the flat roll rolling section, and a period length T of the corrugated curves is less than a width L of the flat roll rolling section, wherein the corrugated curves are the sinusoidal curves, and the corrugated curves of the three rolling flat rolls are the same, and an amplitude A of the corrugated curves added to the flat roll rolling section is guaranteed to skip exceeding a maximum height H of the flat roll rolling section.

3. The corrugated skew rolling preparation method of the magnesium alloy bar with the gradient structure according to claim 1, wherein, in S5, a radius depression rate of the magnesium alloy bar ranges from 5% to 8%.

4. The corrugated skew rolling preparation method of the magnesium alloy bar with the gradient structure according to claim 1, wherein, in S1.2, a radius depression rate of the annealed magnesium alloy bar ranges from 5% to 8%.

5. The corrugated skew rolling preparation method of the magnesium alloy bar with the gradient structure according to claim 1, wherein, in S3, a homogenized annealing temperature is 530° C., and a annealing holding time is 60 minutes.

* * * * *